US005482105A

United States Patent [19]

Rude

[11] Patent Number: 5,482,105

[45] Date of Patent: Jan. 9, 1996

[54] CLUTCH CONTROL FOR ROLLER SHADES

[75] Inventor: Edward T. Rude, Columbia, Md.

[73] Assignee: General Clutch Corporation, Stamford, Conn.

[21] Appl. No.: 241,848

[22] Filed: May 12, 1994

[51] Int. Cl.[6] ..... E06B 9/56

[52] U.S. Cl. ..... 160/307; 160/321; 192/8 C

[58] Field of Search ..... 160/291, 298, 160/307, 308, 319, 321, 323.1; 192/8 C, 81 C, 41 S

[56] References Cited

U.S. PATENT DOCUMENTS

| | | | |
|---|---|---|---|
| 3,135,369 | 6/1964 | Nisenson et al. . | |
| 4,372,432 | 2/1983 | Waine et al. . | |
| 4,424,851 | 1/1984 | Kohayakawa | 160/298 |
| 4,433,765 | 2/1984 | Rude et al. . | |
| 4,729,418 | 3/1988 | Rude . | |
| 4,751,953 | 6/1988 | Appel et al. | 160/321 |
| 4,779,662 | 10/1988 | Wilk | 160/298 |
| 4,865,109 | 9/1989 | Sherman | 160/321 |
| 5,009,259 | 4/1991 | Miloslaus | 160/323.1 |
| 5,029,629 | 7/1991 | Cheng-Pei | 160/321 |
| 5,351,743 | 10/1994 | Jackson | 160/323.1 |
| 5,361,822 | 11/1994 | Nijs | 160/298 |
| 5,375,643 | 12/1994 | Rude | 160/298 |

*Primary Examiner*—David M. Purol
*Attorney, Agent, or Firm*—Gottlieb, Rackman & Reisman

[57] ABSTRACT

A spring clutch mechanism for the operation of roller shades and other rollable items. This clutch mechanism is designed to release for raising the shade so as to minimize effort. Whereas prior art clutch mechanisms for roller shades are intended not to slip, or to slip only to save themselves, in this case, lowering of the shade is accomplished by overriding the clutch, causing it to slip. The clutch can be adapted easily to accommodate know shade weights. The inventive design provides superior operating characteristics and, because the clutch can be built with as few as two parts, much lower cost.

16 Claims, 9 Drawing Sheets

CLUTCH CONTROL FOR ROLLER SHADES

This invention relates to roller systems for window shades, screens, hanging lamps and the like. In its preferred embodiment, it can advantageously be used to raise and lower window shades. The prior art mechanism most commonly used for controlling the vertical position of a roller window shade is the ratchet and pawl mechanism, a recent example of which is shown in U.S. Pat. No. 4,009,745. This mechanism has been in use for many years, but it is notoriously unpopular among users. Criticisms include the necessity of handling the shade material in order to operate the shade, and unreliable operation. Ratchet and pawl mechanisms are often difficult to engage and can only be set at heights corresponding to the tooth spacing of the ratchet.

Other prior art devices for controlling window shades include friction brakes as exemplified by U.S. Pat. Nos. 4,323,105, 4,223,714, and 4,094,904. These devices apply a fixed torque to resist rotation of the shade roller no matter which direction the roller is turned. These devices suffer from the disadvantage that a substantial force is needed to raise the shade. The friction brake must provide a force no less than the weight of the shade that is to be supported. Therefore, when raising the shade, the operator must, at the very least, provide a force equal to twice the weight of the shade, since the weight must be lifted and the brake force must be overcome. It is objectionable to have more friction than is needed. However, friction brakes are quite variable, depending upon heat, humidity, wear, and even the length of time that the shade has been in position. Therefore, friction devices are usually made to be adjustable in the field. This requires expensive field service. A further disadvantage of friction brake mechanisms is that they require a substantial number of component parts, usually including friction pads, a spring, and an adjustment screw.

The prior art also contains examples of clutch mechanisms that are adapted for the operation of roller shades. Among these are U.S. Pat. Nos. 3,135,369, 4,372,432, 4,433,765 and U.S. patent application Ser. No. 995,422. Prior art clutch mechanisms overcome some of the disadvantages of ratchet and pawl devices, but they have some disadvantages of their own. The clutch based devices are operated with cord loops that hang from one end of the shade roller. The cord loop eliminates the need for handling of the shade material or a protective shield attached thereto, and the clutch mechanism allows the height of the shade to be precisely set. It also permits the shade to be operated from one end rather than from the center which can be difficult to reach if the window is behind a piece of furniture. However, clutch devices tend to be somewhat more expensive than the ratchet and pawl devices, and they require some amount of lost motion to insure proper operation. This lost motion is apparent upon beginning to raise the shade. When the cord is first pulled, some motion is required before the shade begins to move. Also, the lost motion can contribute to an oscillating, or surging motion while the shade is lowered.

Our invention provides a mechanism that is similar in many respects to a clutch device in that it is operated by means of a cord loop which hangs from one end of the shade roller. The device of our invention contains fewer parts than the clutches of the prior art. Therefore, it can be less expensive to produce. It also is essentially devoid of lost motion which makes it more aesthetically pleasing to operate. With our inventive clutch mechanism, it is possible to lower the shade by pulling directly on the shade itself without damaging the mechanism. This is an advantage in public buildings where shades are operated by those unfamiliar with cord operation.

BRIEF DESCRIPTION OF THE INVENTION

The preferred embodiment of our invention consists of a device which is irrotatably mounted at one end of a window shade roller. The device contains a means for receiving a wall or ceiling mounted window shade bracket. In a typical installation, the opposite end of the window shade roller would be affixed to a suitable pin or gudgeon arrangement which would be mounted to its own bracket. Neither of these last mentioned items are a part of our invention. Our inventive mechanism provides a holding torque sufficient to support the shade at any elevation. The shade is operated by a cord loop which passes over a pulley in the device. To lower the shade, the operator pulls one leg of the cord loop until the shade is at the desired height. The shade will remain at the selected position with no further action required of the operator. To raise the shade, the operator pulls the other leg of the cord loop until the shade reaches the desired position, again with no further action required to hold it in position.

The preferred embodiment of our invention consists of only two parts, a pulley and a housing, both of which can be produced by injection molding of plastic. The housing is mounted to the wall as described above so that it cannot rotate. The pulley has an extension which fits tightly into a hole in the end of the shade roller, and a further extension in the form of a helical coil spring which fits snugly about a tubular portion of the housing.

When the shade is stationary, the torque due to the weight of the shade material hanging from the roller tends to tighten the helical spring about the tubular core to hold the shade in place. Tension in the operating cord, in the direction which winds the shade onto its roller, loosens the helical spring and reduces its frictional hold on the tubular portion of the housing. This permits the shade to be raised. To lower the shade, the operator pulls on the cord, in the direction that further tightens the helical spring about the tubular portion of the housing, with sufficient force to overcome the holding torque provided by the helical spring. The design of the helical spring and the tubular core are such that there is sufficient holding torque to support shades of most standard sizes while not so great as to make it difficult to overcome in lowering the shade.

The device is, in effect, an overrunning spring clutch that is designed to slip in either direction, but at different values of applied torque. In the direction for raising the shade, the overrunning clutch slips at a low torque because the spring tends to unwind. In the direction for lowering the shade, the clutch requires that a high torque be applied for slippage to occur. However, it is not necessary for the operator to apply all of the torque needed to force the clutch to slip when lowering the shade, because the weight of the depending portion of the shade itself exerts a torque in that same direction. The characteristics of the clutch should be chosen so that it will slip at a torque somewhat greater than the highest torque that can be realized from the weight of the largest shade to be used. In that way, the clutch will be capable of supporting-the shade in any position, and yet lowering the shade will not require excessive operating force.

In elevating the shade, it is, of course, necessary for the operator to apply all of the torque needed to raise the shade. It is a significant advantage of the invention that the clutch releases for motion in the upward direction, so that little additional force is needed beyond that necessary to overcome the weight of the shade itself. In the downward direction, additional force is needed to overcome the holding torque of the clutch, but the weight of the shade contributes some amount of that force, depending on the amount of the shade that is unrolled, so that the total pull on the operating cord is always less than the holding torque of the clutch. Embodiments are disclosed which are configured for use in roller shades and for other types of window coverings. The preferred embodiment uses only two parts, both of which can be molded. An alternative embodiment for the same use and of the same general configuration uses discrete wire springs. This introduction of an additional component part does tend to increase cost, but it simplifies the plastic molds and allows greater adaptability to differing performance requirements. Another embodiment shows the application of our invention to installations in which the mounting is to a board or a headrail. Such installations are appropriate to Venetian blinds, or balloon shades that are raised by cords that lift the shade from the bottom. U.S. Pat. No. 5,228,491 reveals an example of the former, and U.S. Pat. No. 4,623,012 discloses a mechanism for the operation of the latter type of blind.

Accordingly, it is an object of our invention to provide a mechanism for the operation of roller window shades that has the advantages of cord loop operation but is less expensive to manufacture than the similarly operated mechanisms of the prior art.

It is another object of our invention to provide a mechanism for the control and operation of a roller-shade that is more reliable than the conventional ratchet and pawl mechanism.

A further object of our invention is to provide a roller shade mechanism that requires less lifting force than the friction brakes of the prior art.

Yet another object of our invention is to provide a roller shade mechanism with containing the minimum number of parts.

Another object of our invention is to provide a roller shade mechanism with minimal lost motion.

An additional object of our invention is to provide a clutch controlled roller shade mechanism that does not exhibit a surging or oscillatory motion while being lowered.

Other objects and advantages of our invention will become apparent from the descriptions that follow.

BRIEF DESCRIPTION OF THE DRAWINGS

Further understanding of our invention will become apparent upon consideration of the following detailed description in conjunction with the drawings, in which.

DETAILED DESCRIPTION OF THE INVENTION

Figure 1:
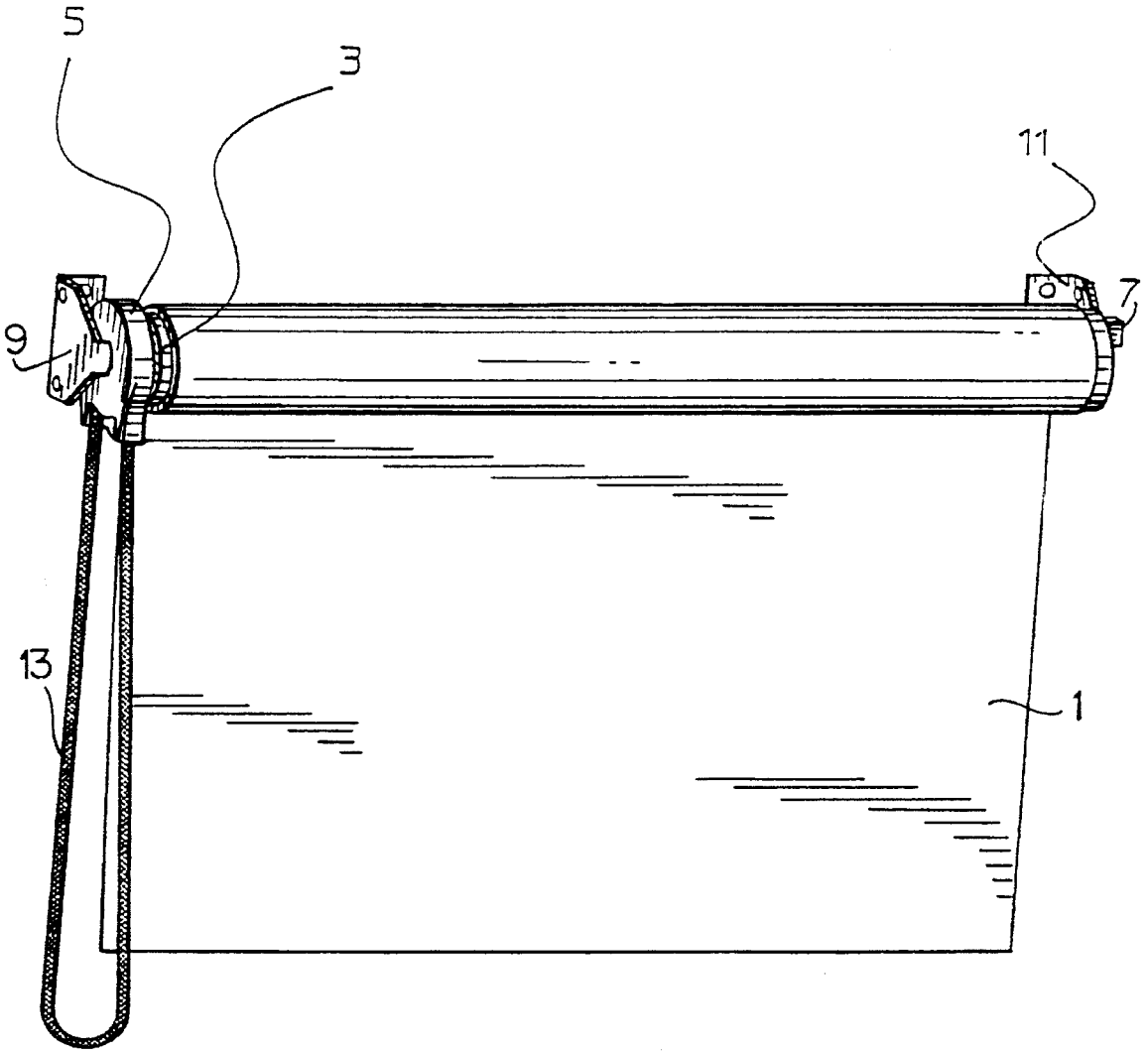
FIG. 1 Is a view of a roller shade in which the clutch of our invention has been installed and mounted on brackets.

FIG. 1 shows a mounted shade and roller assembly. Shade material 1 is partially wound around roller 3. Clutch assembly 5 is inserted into the one end of roller 3 and is prevented from slipping by the friction of a tight fit, or by contact between some feature on the inside of roller 3 and the outside of the sleeve portion of the pulley that fits therein, as described later. Pivoting assembly 7 is inserted into the opposite end of roller 3. Brackets 9 and 11 support the shade and roller assembly. The brackets and the pivoting assembly depicted are made according to U.S. Pat. No. 4,729,418, but many other types would also be usable. The height of the shade is adjusted by pulling on one or the other side of cord loop 13.

Figure 2:
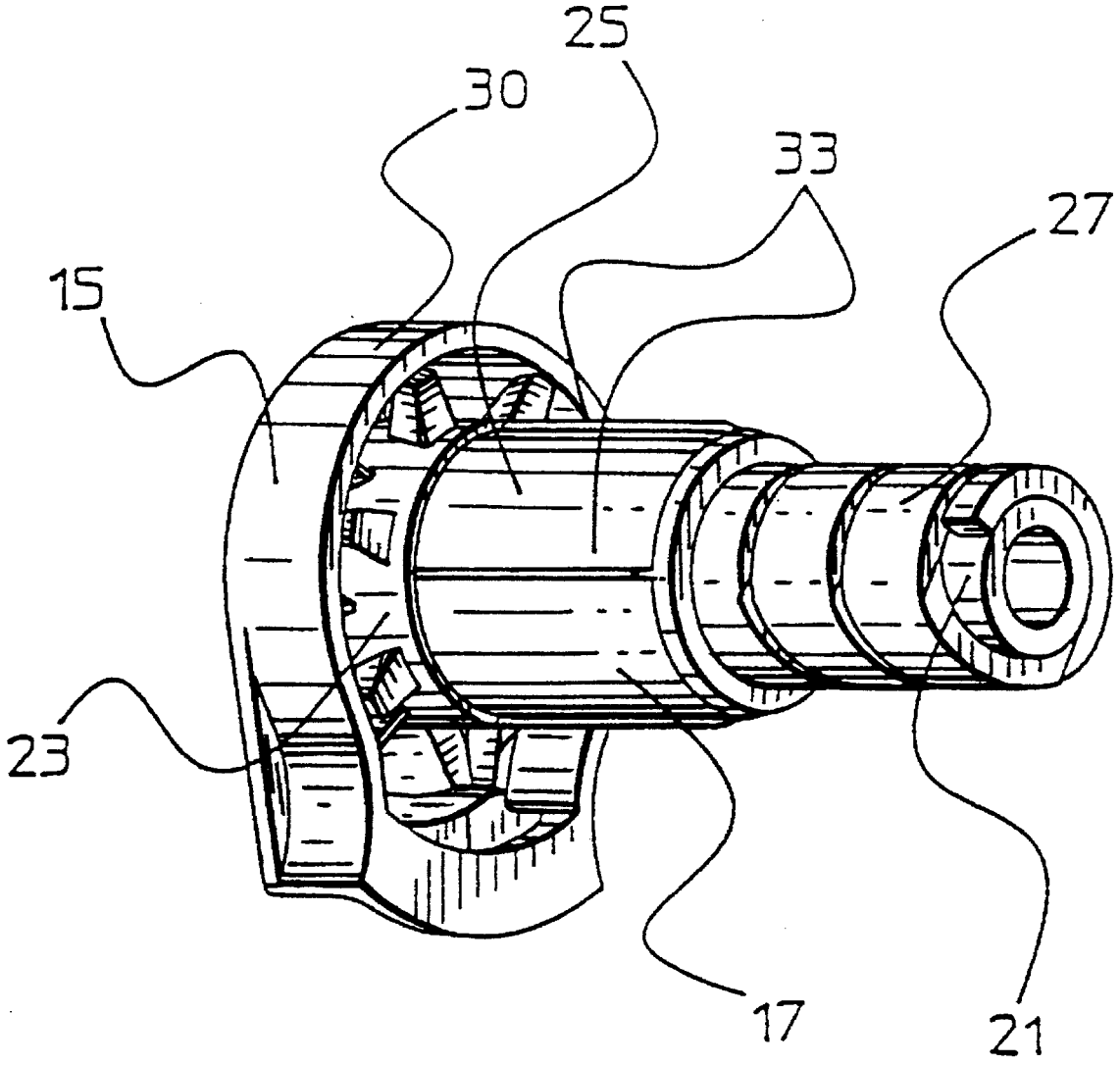
FIG. 2 is a perspective view of the preferred embodiment of the inventive roller window shade clutch showing the end which, in use, is inserted into an opening in the end of the shade roller.
Figure 3:
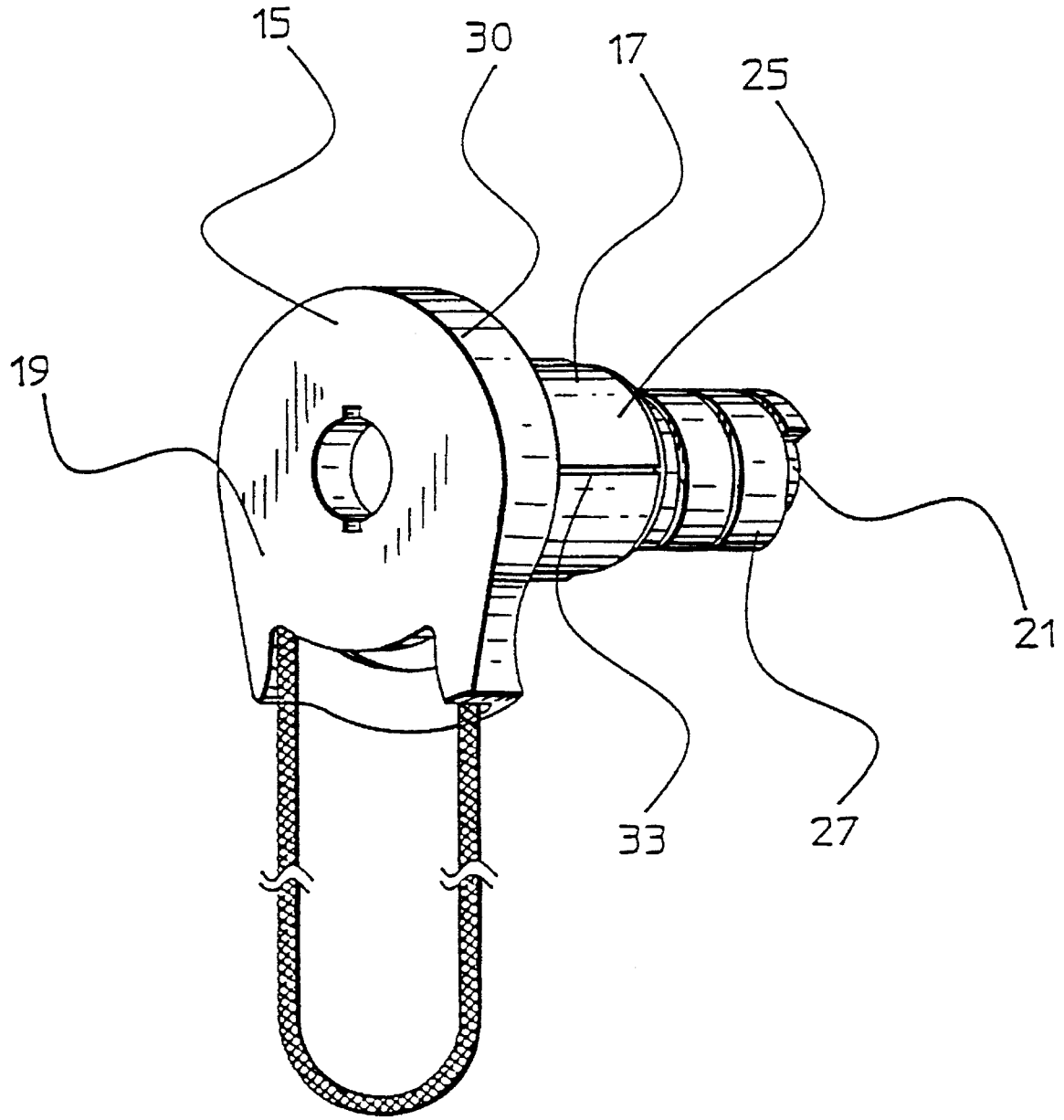
FIG. 3 is another perspective view of the same clutch showing the opposite face of the clutch, together with its bracket and cord loop.
Figure 4:
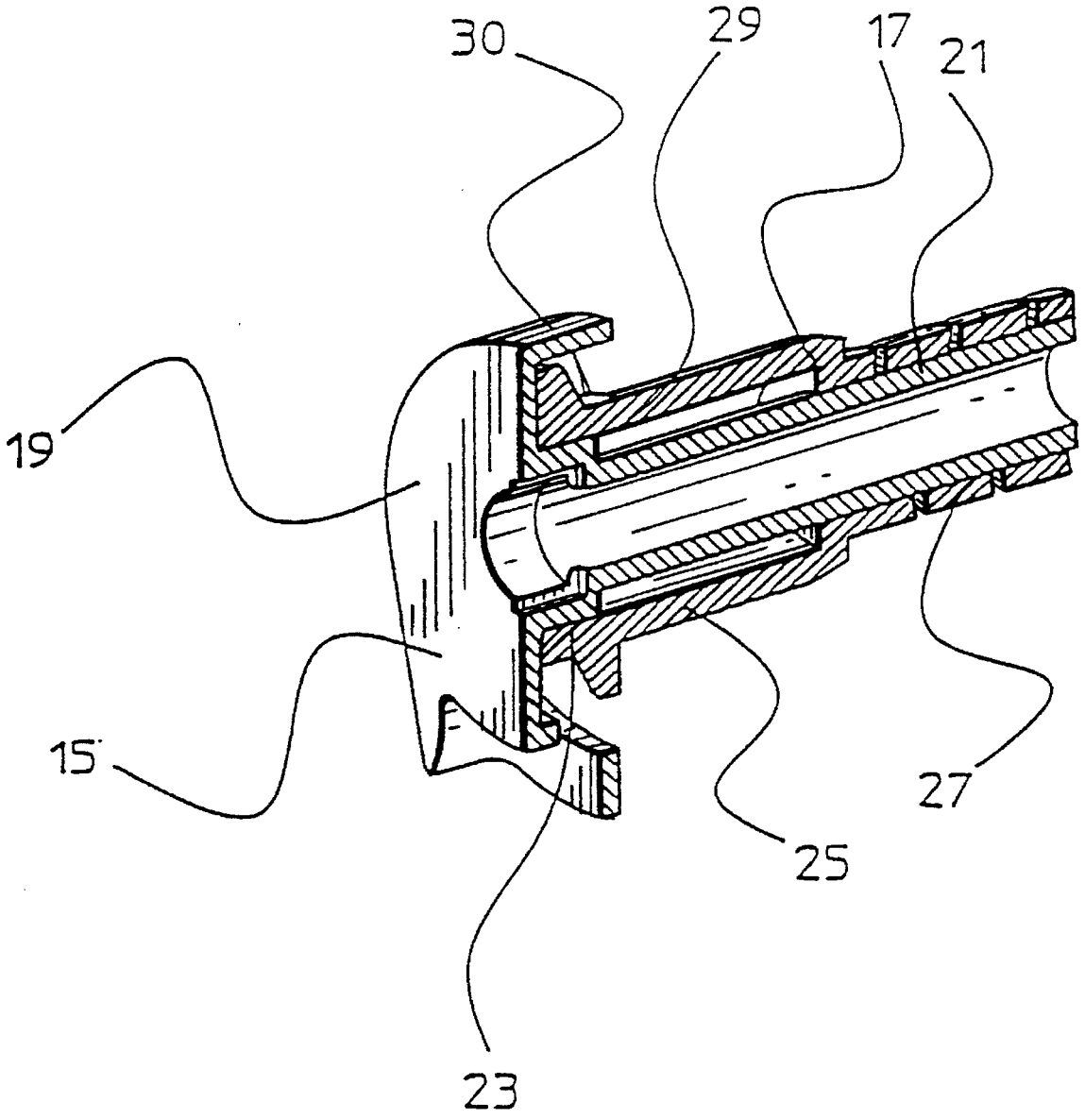
FIG. 4 is a perspective view of the clutch, similar to the view of FIG. 1, but from a different angle, and with one half of the clutch cut away.

FIGS. 2–4 depict the preferred embodiment of our inventive clutch. In this embodiment, the clutch assembly is comprised of two parts, fixed housing element 15 and rotating pulley element 17. Fixed housing element 15 is generally comprised of shroud portion 19 and cylindrical extension 21. Rotating pulley element 17 is generally comprised of three portions, pulley 23, sleeve 25, and spring 27. Each of the two parts, fixed housing element 15 and rotating pulley element 17, can be formed in a single piece which can be injection molded using a plastic material or die cast using a metal such as zinc.

Shroud portion 19 of fixed housing element 15 has bearing sleeve 29, best seen in FIG. 4, about which pulley 23 is piloted. Outer rim 30 of shroud portion 19 is formed so as to keep cord loop 13 in engagement with the pulley teeth and to act as a cover and guide for the cord.

Sleeve 25 of rotating pulley element 17 is formed so as to fit irrotatably into roller 3. In the preferred embodiment, this is accomplished by a number of small ribs 33 which slightly deform roller 3 upon insertion. This deformation provides sufficient frictional contact between the roller and the clutch to permit the shade to be rolled onto the tube without slippage. If the sleeve were to have a circular outside shape, then any variation in the size of either part would cause the fit to be too loose or too tight.

Spring 27 of rotating pulley element 17 must have an inside diameter that is slightly smaller than the outside diameter of cylindrical extension 21 of fixed housing element 15. When the fixed and rotating elements are assembled, spring 27 must be slightly expanded to fit over cylindrical extension 21. The fixed and the rotating elements form a wrap spring clutch that is configured to slip in one direction almost without resistance, and to provide moderate resistance to slippage in the other direction. The rotational direction in which resistance is produced depends upon the direction in which the helix of spring 27 is formed.

Helical spring 27, as seen in FIG. 3, will slip easily when rotating pulley element 17 is rotated in the clockwise direction. This rotation tends to unwind spring 27 and loosen its grip on cylindrical extension 21 of fixed housing element 15. Counter-clockwise rotation tends to tighten the grip of spring 27 about cylindrical extension 21. When cord loop 13 is pulled so as to produce clockwise motion of roller 3, as seen from the clutch end in FIG. 1, shade material 1 will be elevated. This is the rotational direction, as explained above, in which clutch assembly 5 releases and provides little resistance to rotation. When cord loop 13 is released, the weight of shade material 1 that is hanging from roller 3 produces a force that tends to rotate roller 3 in a counter-clockwise direction as seen from the clutch end. The resistance provided by clutch assembly 5 to that rotation holds the shade in position.

To lower the shade, the opposite side of cord loop 13 is pulled. This increases the force tending to rotate element 17 in the counter-clockwise direction. When that force exceeds the holding capability of clutch 5, the clutch slips, permitting the shade to be lowered. When cord 13 is no longer pulled, clutch assembly 5 again holds shade 1 in position.

As mentioned above, the clutch mechanism provides a significant advantage over symmetric friction brake devices because, in those devices, the friction must also be overcome when raising the shade, whereas, the clutch of our invention releases when raising the shade so that the force required is only slightly greater than the weight of the shade.

Care is needed in the design of spring 27 and cylindrical extension 21. Those who are expert in the art of wrap spring clutches will be familiar with the methods and techniques required. The important factors are the number of coils in the spring, the amount by which the spring must expand to fit over the cylindrical extension, the thickness, the width and the bending characteristics of the spring coils, and the coefficient of friction between the spring and the cylindrical extension. In the present example, the clutch must provide sufficient resistance to clockwise movement to support the weight of the shade material and yet not so much resistance as to make lowering of the shade too difficult.

The prior art does contain examples of other wrap spring clutch mechanisms used to operate roller shades. However, none of the prior art devices is comprised of only two component parts. It is an additional advantage of this inventive clutch that each of the two component parts can be die cast or injection molded. No additional manufacturing operations are required except for the very simple assembly operation of fitting the two parts together.

Some prior art clutches offer the advantage that they can operate in either direction of rotation. This is an important consideration where it cannot be determined in advance which direction of rotation will be required. However, bi-directional clutch devices contain a larger number of parts which makes them more expensive to manufacture. The clutch of our invention requires prior determination of the direction in which the shade is to be wound onto the roller. The need to predetermine the direction of winding, together with the potential for low manufacturing cost, make this invention an ideal clutch mechanism for prefabricated shades.

Another limitation inherent in the design of our inventive clutch is that the approximate weight of the shade determines the design of the clutch spring. However, the more complex and more expensive clutch mechanisms also come in various sizes to accommodate shade of differing weights. Since our clutch mechanism is likely to find its major application in mass produced, prefabricated shades, this consideration is not really a limitation at all. Most prefabricated, mass produced shades are made of rather light shade material and they are made for the most popular and standard window sizes. Therefore, the range of weights that such a mechanism would be expected to support can be rather limited. It is to be expected that larger and non-standard window sizes would continue to be fitted with prior art clutches. Since these shades are made to order, they are more expensive and can bear the additional cost of more expensive hardware.

An advantage inherent in the design of our clutch is the absence of lost motion. On the other hand, many prior art clutches require a substantial movement of the pulley before the shade begins to move.

An alternative embodiment of our invention can advantageously be constructed by separating the spring portion from the remainder of rotating element. In the preferred embodiment of FIGS. 2–4, this corresponds to separating spring 27 from the rest of rotating pulley element 17. Keeping the spring as a separate part allows the clutch more easily to suit a variety of shade sizes and weights. And, of course, the rotational direction can be more easily altered.

Figure 5:
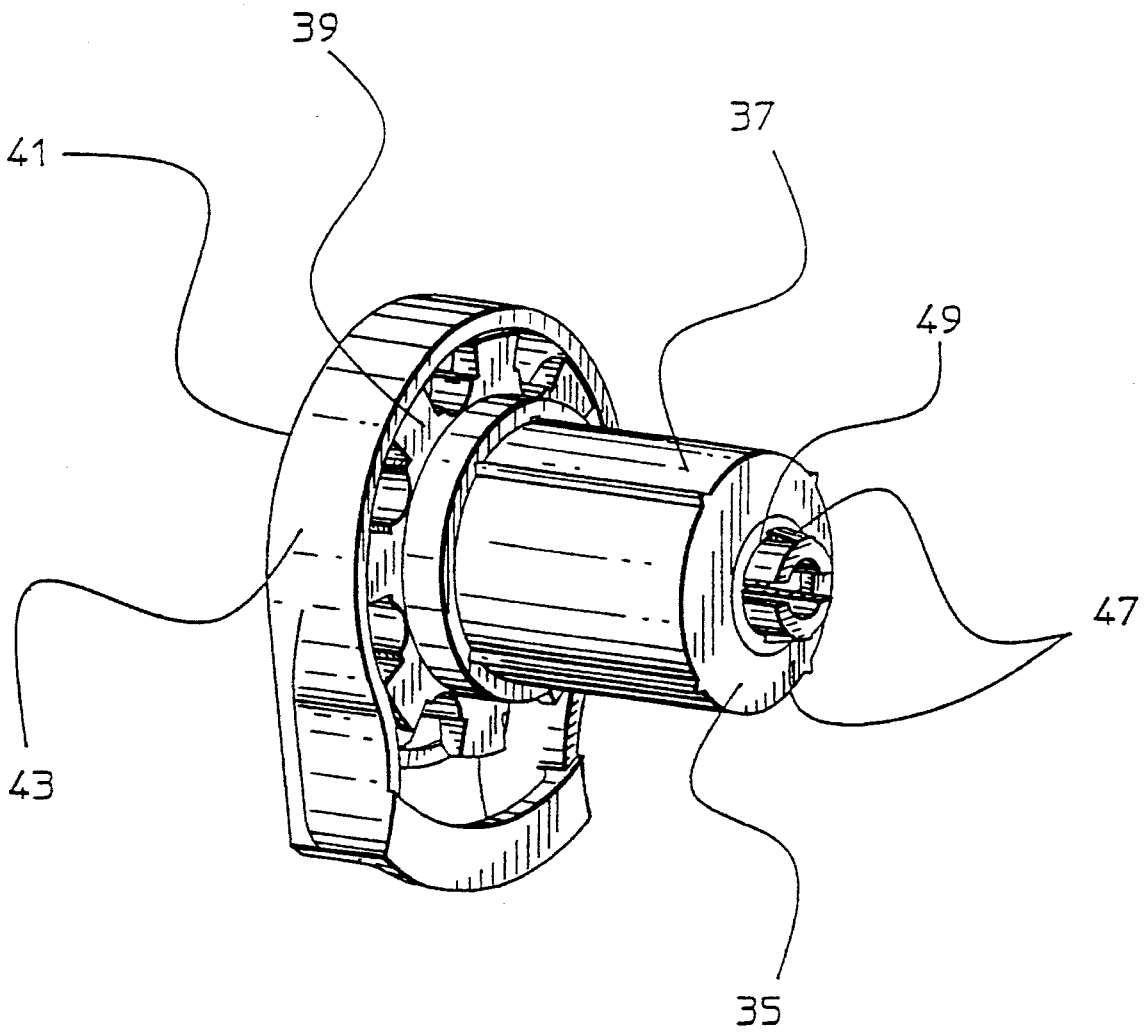
FIG. 5 is a perspective view of another embodiment of the invention.
Figure 6:
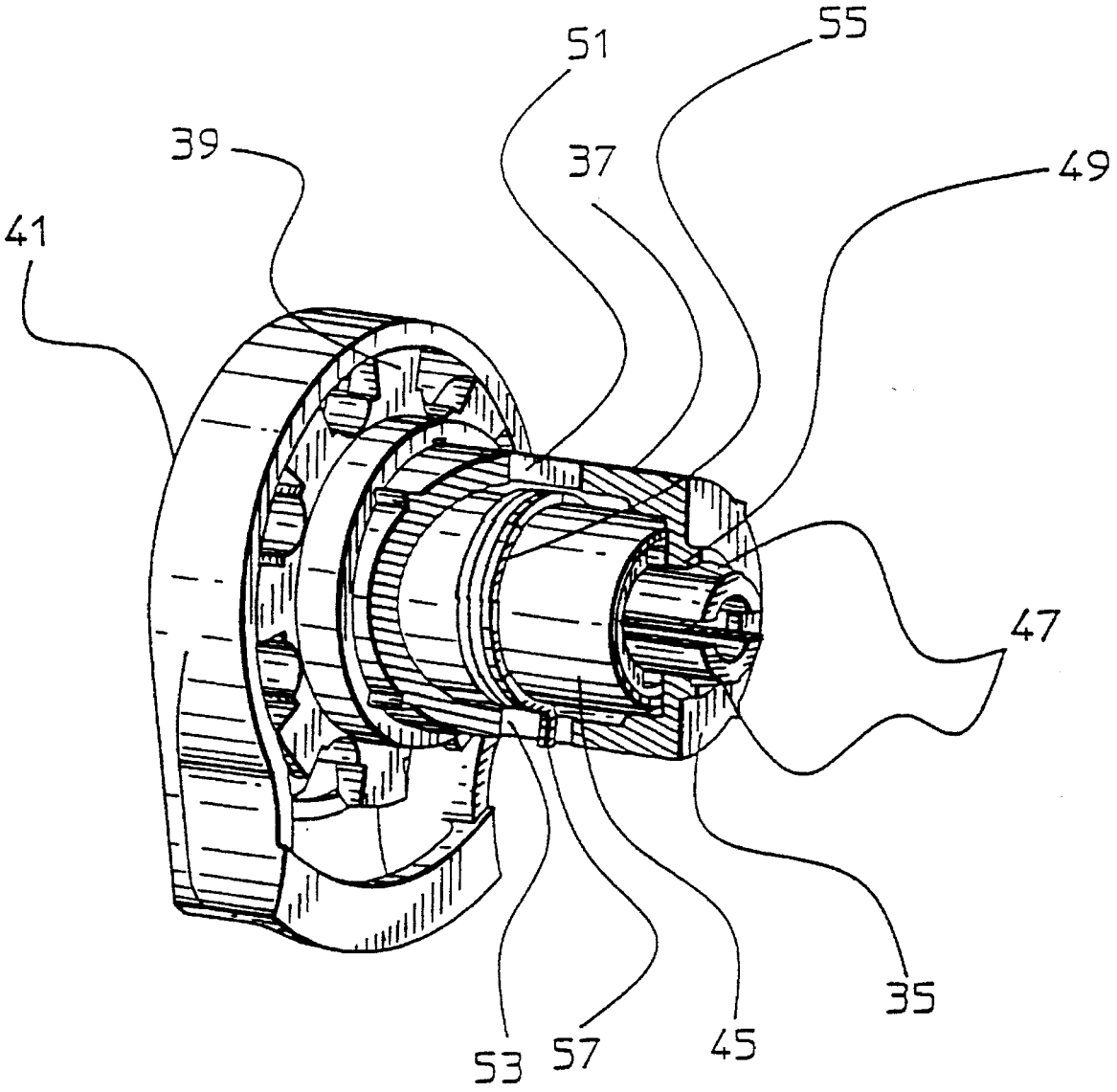
FIG. 6 is a perspective view of the clutch of FIG. 5, cut-away to show the spring.

FIG. 5 shows the assembled clutch of this second embodiment of the invention. Rotating element 35 is comprised of cylindrical sleeve 37 which is configured to fit into a shade roller, and pulley 39 adapted to receive the operating cord or chain. Fixed element 41 includes shroud portion 43 which covers pulley 39 and retains the cord or chain. As shown in FIG. 6, the clutch assembly includes cylindrical extension 45 of fixed element 41. The clutch is held together by barbs 47 which are molded as a part of fixed element 41 and which protrude through hole 49 located at the end of rotating element 35.

As can be seen in FIG. 6, rotating element 35 has two slots, 51 and 53, axially oriented on opposite sides of the outer walls of sleeve 37. Spring 55 is formed in a closely wound cylindrical helix to fit snugly about cylindrical extension 45. Spring 55 has one end formed into radially extending tail 57. During assembly, as rotating element 35 is fitted over cylindrical extension 45, slot 53 is aligned with tail 57 and they fit together with minimal clearance. After assembly, sleeve 37 and spring 55 rotate together, as one piece. Spring 55 acts in the same way as spring 27 of the preferred embodiment. However, this embodiment provides the advantage that the characteristics of spring 55 can be easily modified to accommodate a wide range of shade sizes and weights. Those with expertise in the art of spring clutch design will realize that, among the parameters that can be adjusted are, the grip of spring 55 on cylindrical extension 45, the number of turns of spring 55, and the size of the wire of which spring 55 is wound.

Figure 7:
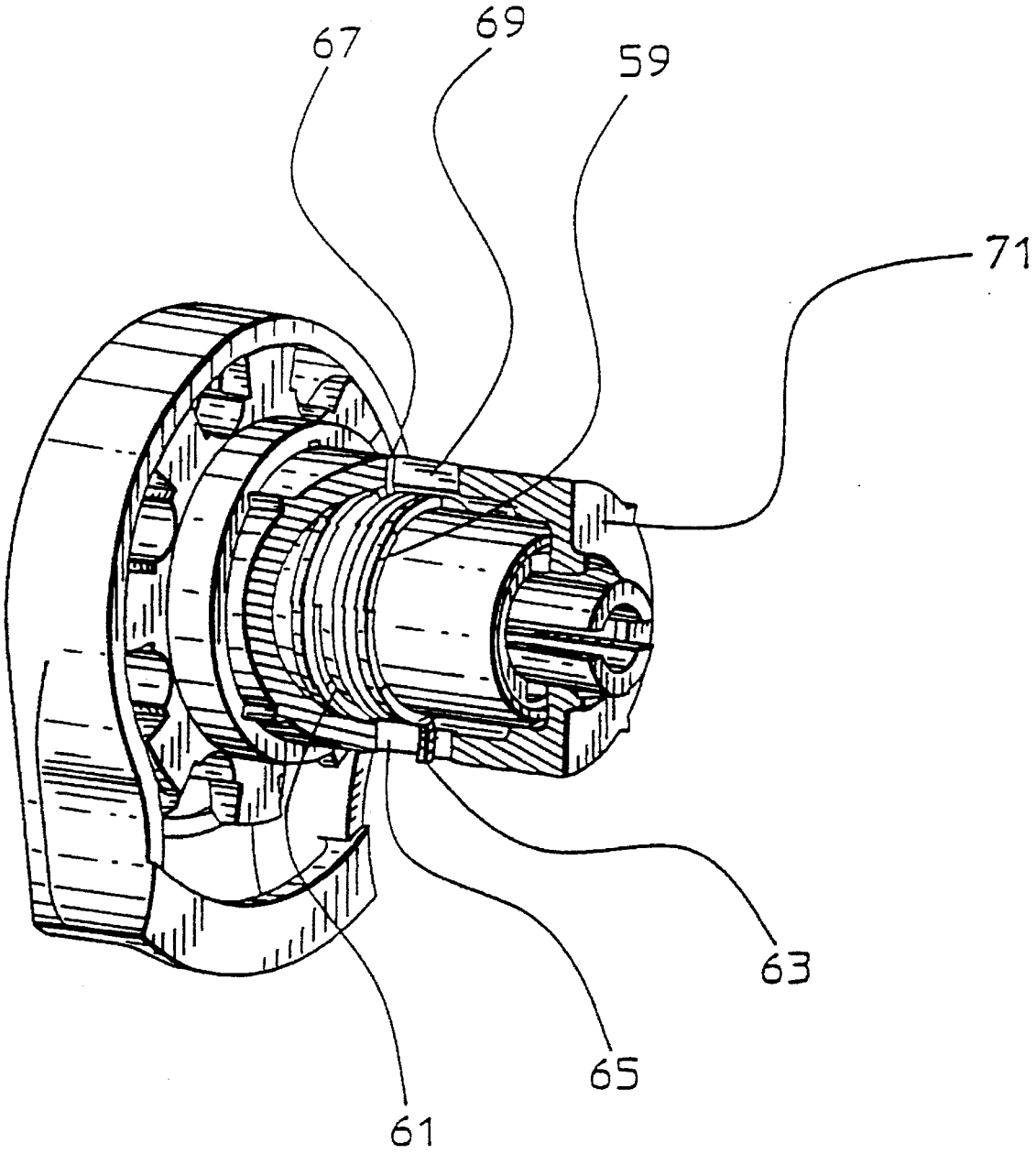
FIG. 7 is a perspective, partially cut-away view of a third embodiment of our inventive clutch that employs two springs; and, FIG. 8 is a perspective view of a clutch similar to the embodiment of FIG. 7, but made from two molded parts.

FIG. 7 shows another embodiment of our invention. As shown, the clutch assembly uses the same molded parts as are used in the embodiment of FIGS. 5 and 6, although this is clearly not a requirement. In this embodiment, two springs 59 and 61 are employed. Spring 59 has tail 63 which is captured in slot 65, and spring 61 has tail 67 which is captured in slot 69 on the opposite side of sleeve 71. One of the advantages of using two springs in this manner are, as discussed in U.S. Pat. No. 4,433,765, that each of the spring can have fewer turns which provides for smoother operating characteristics. Another advantage is discussed in U.S. patent application Ser. No. 995,422. This document discloses a method of using two springs in a balanced configuration to eliminate bearing loads that otherwise occur in spring clutches of this configuration. The two spring arrangement of the clutch of FIG. 7 accomplishes the same reduction in bearing loads, resulting in improved operating characteristics.

Figure 8:
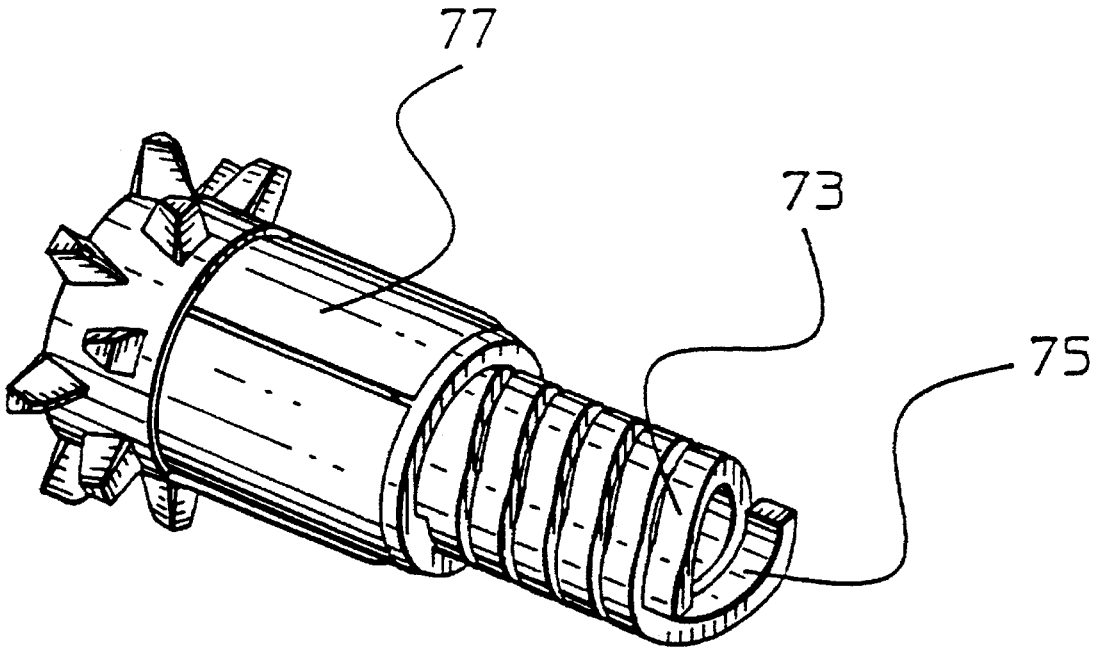

FIG. 8 shows a clutch assembly with the same operating algorithm as the clutch of FIG. 7, but in which the two springs 73 and 75 are molded as a part of rotating element 77. This has the advantage of only two component parts, but lacks the adaptability of the version with separate wire springs.

In the case of roller shades, it is usually the central element of the clutch that is fixedly mounted to a wall or ceiling. This permits the external, rotating element to be fitted into the shade roller, as exemplified by the embodiments above described. However, this mounting arrangement is often inconvenient. Accordingly, FIG. 9 discloses an embodiment of the inventive clutch in which the stationary element is the exterior one. This facilitates the mounting of the clutch to a headrail, such as is commonly used with Venetian blinds. This mounting is also convenient where a wooden or aluminum headboard is employed. The controlling torque of the clutch is transmitted to the mechanism for lifting the blind by a rod or shaft axially affixed to the central element. Like the preferred embodiment of our invention, the embodiment of FIG. 9 has only two component parts. And, it will be easily understood that the variations shown in FIGS. 5–8 can, as well, be incorporated into the general design depicted in FIG. 9.

Figure 9:
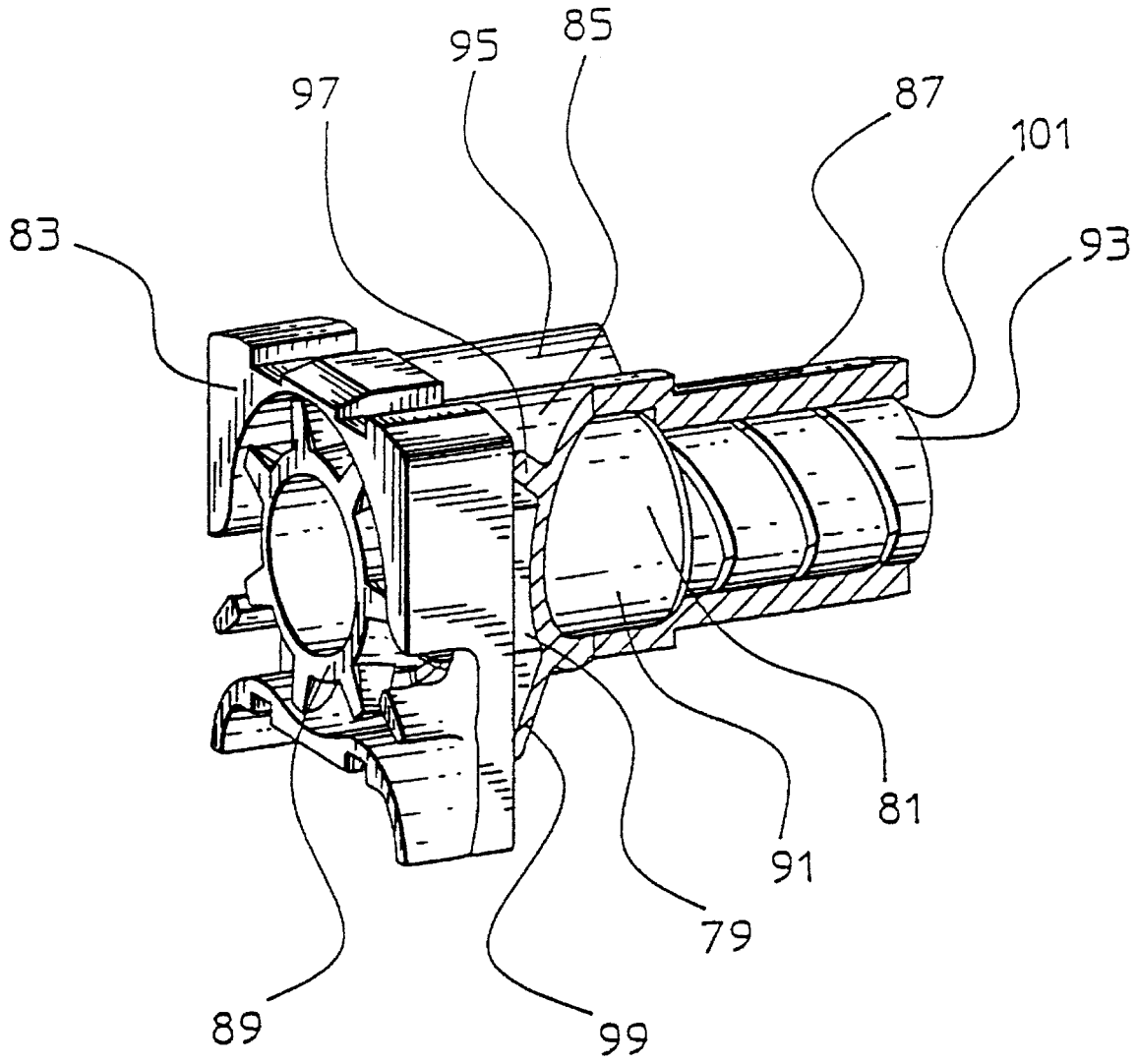
FIG. 9 is a partially cut-away, perspective view of an alternative embodiment of the inventive clutch configured for mounting by the outside element rather than the inside element.

Referring now to FIG. 9, The two component parts of the clutch are fixed housing 79 and rotating pulley element 81. Generally, fixed housing 79 is comprised of shroud portion 83, bearing and mounting portion 85, and shaft portion 87, while rotating pulley element 81 is comprised of pulley portion 89, bearing portion 91, and spring portion 93. Shroud portion 83 covers the pulley and, in the particular part shown, provides exit slots in both the front and back for the operating cord loop which is not shown. The clutch is assembled by inserting rotating pulley element 81 into fixed housing 79. A cover, which is not shown, snaps over the open face of shroud portion 83 to keep the clutch together. Bearing and shaft portion 85 has four mounting ribs for positioning in a roll formed Venetian blind headrail. In FIG. 9, rib 95 is visible, and ribs 97 and 99 are partially visible, having been cut away to show the interior of the clutch. Shaft portion 87 extends axially from bearing and mounting portion 85 of fixed housing 79. It is with the cylindrical inside surface of shaft portion 87 which spring portion 93 of rotating pulley element 81 makes contact to produce the clutching action. It is characteristic of spring clutches, having helical springs radially confined within a cylinder, that the springs tend to expand in the axial direction when loaded. To prevent such expansion of spring portion 93, shaft portion 87 of fixed housing 79 has shoulder 101 whose inside diameter is slightly smaller than the inside diameter of spring portion 93.

As with the previously described embodiments, rotating the pulley in one direction releases the grip of spring portion 93 of rotating pulley element 81 on shaft portion 87 of fixed housing 79, permitting easy movement in that direction. For the clutch shown in FIG. 9, that direction of rotation of the pulley is clockwise. In order for the pulley to rotate in the other, counter-clockwise direction, it is necessary for that sufficient torque be applied through the operating cord to the pulley to overcome the holding capability of the clutch and cause it to slip. Again as before, the clutch must be designed so that this torque can be easily provided by the operator of the shade. And, as before, the weight of the shade contributes to this torque.

It will thus be seen that the objects set forth above among those made apparent from the preceding description, are efficiently attained and, since certain changes may be made in the construction of the inventive spring clutch without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

I claim:

1. A spring clutch assembly for a window shade system comprising:

a fixed housing element including an extending shaft;

a rotating pulley element comprising a pulley member rotatably mounted to said housing element and adapted to receive therealong an operating cord or chain;

at least one helically wound axially mounted spring which makes a frictional braking contact with said shaft and having one end thereof irrotatably affixed to said rotating pulley element.

2. The spring clutch assembly of claim 1, wherein the shaft has an outer substantially cylindrical surface and said at least one spring is disposed about said surface for making frictional contact with the shaft.

3. The spring clutch assembly of claim 1, wherein said housing element further includes a shroud member for substantially enclosing said rotatable pulley member.

4. The spring clutch assembly of claim 3, wherein said shroud member includes a surface adapted for guiding said cord or chain along said pulley member.

5. The spring clutch assembly of claim 2, wherein said pulley element further includes a sleeve extending from said pulley member and coaxially disposed and rotatably mounted over at least a portion of said extending shaft.

6. The spring clutch assembly of claim 5, wherein said sleeve is adapted to irrotatably receive thereabout a roller of said window shade assembly.

7. The spring clutch assembly of claim 6, wherein said sleeve has an outside surface formed with a plurality of ribs to facilitate frictional contact between said received roller and said sleeve.

8. The spring clutch assembly of claim 5, wherein said extending shaft includes a first portion over which said sleeve is coaxially disposed and a second portion extending beyond said disposed sleeve.

9. The spring clutch assembly of claim 5, wherein said at least one spring is located between said sleeve and said shaft.

10. The spring clutch assembly of claim 9, wherein said sleeve is formed with a least one slot therein.

11. The spring clutch assembly of claim 10, wherein said one end of said at least one spring is disposed in said at least one sleeve slot.

12. The spring clutch assembly of claim 1, wherein said at least one spring comprises a pair of axially mounted springs in order to substantially eliminate bearing loads in said clutch assembly.

13. The spring clutch assembly of claim 1, wherein said at least one spring is integrally formed with said rotating pulley element.

14. The spring clutch assembly of claim 1, wherein said shaft has an inner substantially cylindrical surface and said at least one spring is disposed along said surface for making frictional contact with the shaft.

15. The spring clutch assembly of claim 14, wherein said shaft includes an inside shoulder with a diameter slightly smaller than that of said shaft.

16. The spring clutch of claim 8, wherein said at least one spring is mounted about said shaft along said shaft second portion.

* * * * *